United States Patent [19]

Berend

[11] 4,050,227

[45] Sept. 27, 1977

[54] SPINDLE HAVING AN UNDERWIND CROWN FOR RING SPINNING AND RING TWISTING FRAMES, ESPECIALLY FOR CORD TWISTING FRAMES

[75] Inventor: Wolfgang Berend, Durach, Germany

[73] Assignee: Saurer-Allma GmbH Allgauer Maschinenbau, Kempten, Germany

[21] Appl. No.: 726,917

[22] Filed: Sept. 27, 1976

[30] Foreign Application Priority Data

Oct. 6, 1975 Germany ..... 7531710[U]

[51] Int. Cl.[2] ..... D01H 11/00; D01H 1/38

[52] U.S. Cl. ..... 57/34.5; 57/34 TT; 57/34 PW

[58] Field of Search ..... 57/34 R, 34 TT, 34.5, 57/56; 242/18 EW, 18 PW

[56] References Cited

U.S. PATENT DOCUMENTS

| | | | |
|---|---|---|---|
| 2,207,105 | 7/1940 | Payne | 57/34.5 UX |
| 2,485,776 | 10/1949 | Roberts | 57/34 TT |
| 2,800,762 | 7/1957 | Wurmli | 57/34 TT X |
| 2,932,149 | 4/1960 | Ingham, Jr. | 57/54 |
| 3,210,922 | 10/1965 | Winter | 57/54 |
| 3,284,026 | 11/1966 | Zuidema | 57/34 TT X |
| 3,321,901 | 5/1967 | Adams et al. | 57/34 TT X |
| 3,439,356 | 9/1967 | Nikel et al. | 57/34 TT |
| 3,695,018 | 10/1972 | Angst et al. | 57/34 PW |
| 3,768,242 | 10/1973 | Angst et al. | 57/34 PW |

*Primary Examiner*—John Petrakes

*Attorney, Agent, or Firm*—Blanchard, Flynn, Thiel, Boutell & Tanis

[57] ABSTRACT

Spindle for ring spinning and ring twisting frames, especially for cord twisting frames, having an underwind crown arranged coaxially on the spindle below the bobbin and above the whorl, the crown having an extensive sleeve part for the winding-on of a thread during underwinding and an annular rim extending outwardly with recesses at the periphery and adjoining the sleeve part upwardly, from the base of which rim there may project cutting edges of at least one knife. With ring spinning or ring twisting frames equipped with such spindles the ring bank, after a predetermined measured length of thread has been wound on the bobbin, falls to a so-called underwind stop, by which the spindle drive is switched off. The traveller and twisting ring are located at a level at which during decrease of the spindle drive down to standstill of the spindles the thread is no longer wound on the bobbin but is wound on the cylindrical sleeve part of the underwind crown. When the full bobbin is taken off the spindle the thread leading from the bobbin to the windings on the sleeve part of the underwind crown is cut.

14 Claims, 3 Drawing Figures

SPINDLE HAVING AN UNDERWIND CROWN FOR RING SPINNING AND RING TWISTING FRAMES, ESPECIALLY FOR CORD TWISTING FRAMES

FIELD OF THE INVENTION

This invention relates to a spindle for ring spinning and ring twisting frames.

BACKGROUND OF THE INVENTION

In a known spindle of this type (see German Auslegeschrift No. 2,220,355) this cutting is effected by hand, whereupon the end of the thread, after the setting of a new bobbin, is wound around the empty bobbin and then has to be secured by means of loops or knots. In order that upon sinking of the ring bank below the bobbin foot the thread may pass over to the underwind, there are provided on its outwardly directed annular rim recesses that act like entraining grooves.

In another known spindle of the type referred to initially (see German Offenlegungsschrift No. 2,461,621) cutting edges of a substantially circular knife project from the bases of the said recesses. At the cutting edge the thread, which during underwinding has laid itself in the recesses, is cut when the bobbin is drawn upwardly from the spindle. On the substantially cylindrical sleeve part of the underwind crown there are then still located a few windings of the thread coming from the traveller. Upon movement of the ring bank over the bobbin foot there occurs — again with the cooperation of the recesses already mentioned in the annular rim of the underwind crown — the thread passes over the bobbin and can be wound thereon. With the above-mentioned known spindle the risk then occurs that upon acceleration of the ring bank the thread is cut by the knife in the base of the recesses, so that the thread coming from the traveller no longer winds on to the bobbins owing to the thread in the initial windings not being held. In dependently thereof the known spindle of the type above-mentioned has also the further important disadvantage that in the course of winding a bobbin the thread, a few windings of which are on the underwind crown, loosens and becomes free and can lead to damage of adjacent parts of the frame or during winding of adjacent bobbins can lead to torn threads and to considerable soiling of the frame. In particular, in cord twisting frames on which material of relative high stiffness is made release of the thread windings wound on the underwind crown occurs to a considerable extent.

The invention is based on the problem, whilst avoiding the above-mentioned disadvantages, of providing a spindle for ring spinning and ring twisting frames, especially for cord twisting frames, of the type referred to initially wherein after bobbin exchange threads coming off the underwind crown and any broken threads cannot cause any trouble in the winding of adjacent bobbins or damage to frame parts located in the vicinity. Furthermore, in an advantageous form of the invention with a spindle equipped with a disc bobbin the underwind crown of which is furnished with cutting knives, the risk of cutting the thread upon starting of the ring bank is avoided.

For the solution of the problem, in a spindle of the type referred to initially there is arranged around the cylindrical sleeve part of the underwind crown an upwardly open thread catch box the annular base of which extends outwardly from the lower end of the sleeve part, and the outer wall of which extends to the level of the upper end of the sleeve part, leaving an annular gap between itself and the annular rim. Owing to this arrangement the thread wound on the underwind crown, if it comes loose from the sleeve part after restarting of the frame does not reach adjacent frame parts or extend into the vicinity of adjacent bobbins and cause trouble. On the contrary, it is held by the catch box. The threads gathering in the catch box need to be removed therefrom only after a large number of bobbin changes. Until then, upon change of bobbin only the full bobbin needs to be removed and an empty bobbin placed on the spindle. Further work, such as cleaning torn threads from the twisting frame or repairing damage caused by these threads, is not necessary.

In development of the invention, in the case of a spindle with disc bobbins and underwind crown in which knives are provided in the recesses in the annular rim, the diameter of the lower bobbin disc is advantageously larger than the diameter on which the cutting edges of the knives are located. This has the effect that upon restarting the ring bank the thread guided upwardly from the sleeve part of the underwind crown is fed not around a knife but around the outer margin of the bobbin disc to the internal core of the bobbin, so that undesired cutting of the thread before the actual winding starts cannot occur.

BRIEF DESCRIPTION OF THE DRAWINGS

Further details, and preferred forms of the invention that are the subjects of sub-claims, are explained in more detail below with reference to a practical example illustrated in the drawings, in which:

DETAILED DESCRIPTION

Figure 1:
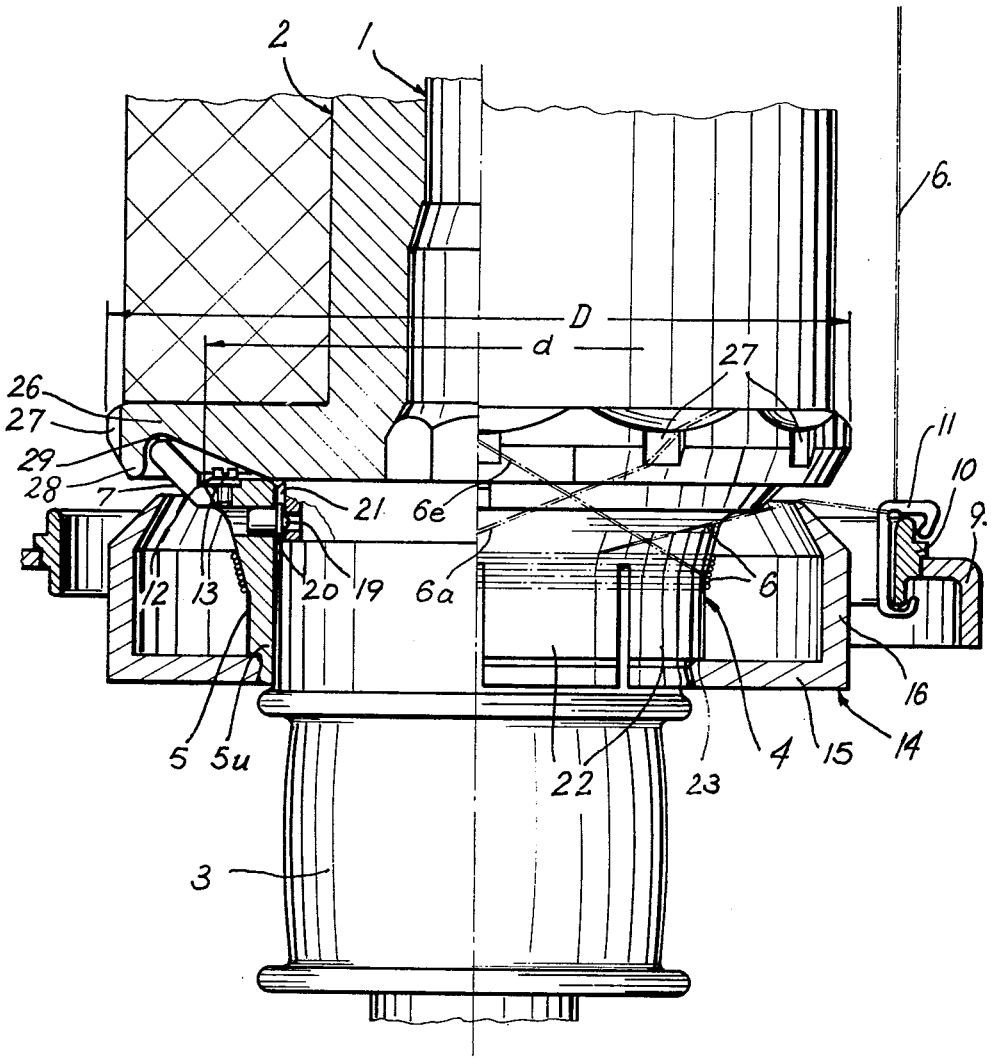
FIG. 1 shows a spindle with a fully wound bobbin, partly in section.

In the drawings, 1 indicates the spindle of for example a cord ring twisting frame, on which a bobbin is placed. Beneath the bobbin 2 and above the whorl 3 an underwind crown 4 is arranged coaxially on the spindle, which crown has an extensive cylindrical sleeve part 5 for the winding on of a thread 6 during so-called underwinding, and an annular rim 7 adjoining the sleeve part upwardly and extending outwardly, having recesses 8 at the periphery.

Figure 2:
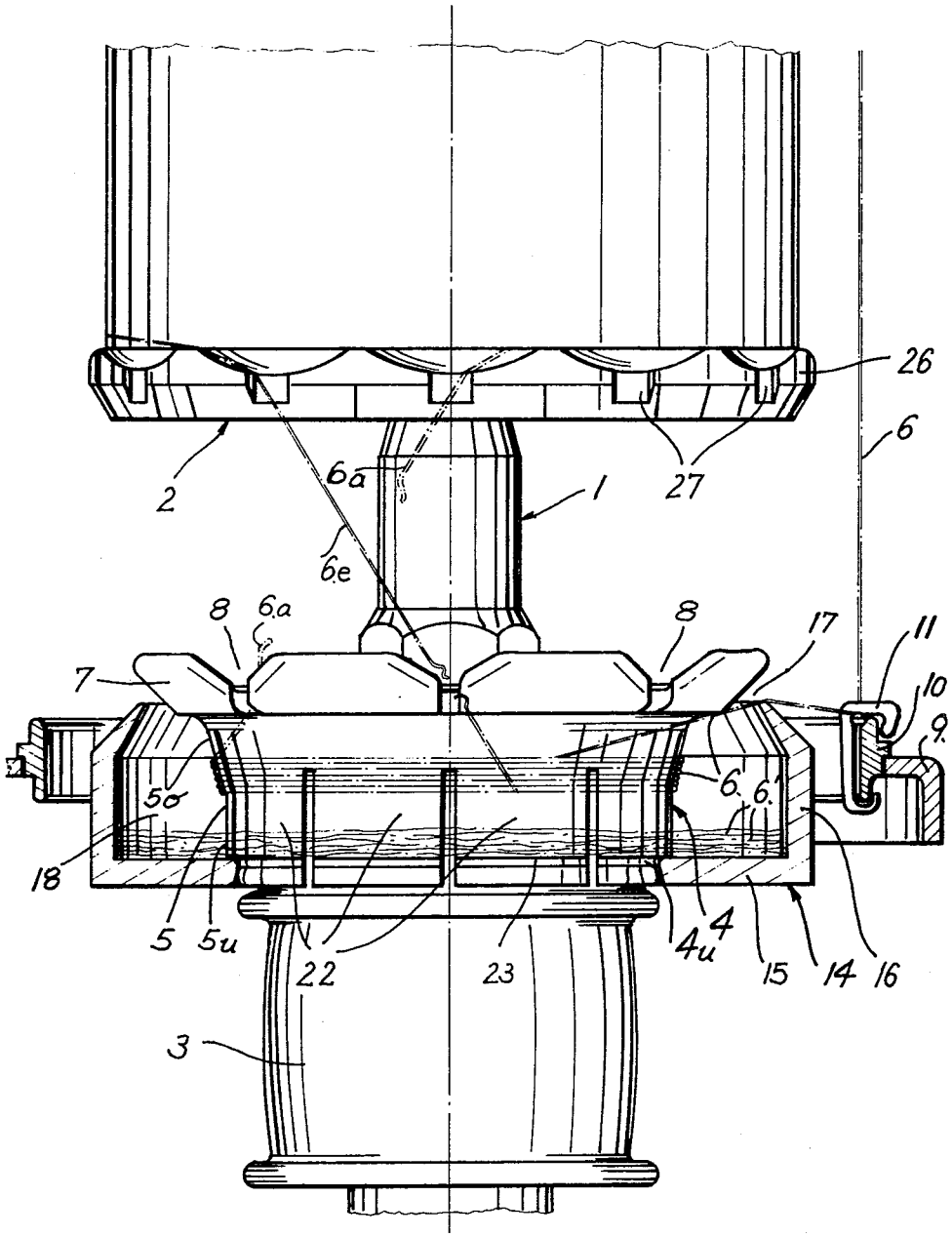
FIG. 2 is a view corresponding to FIG. 1, but with the bobbin removed.

In FIG. 1 of the drawings is shown the ring bank 9, the twisting ring 10 and the traveller 11 in an upper position in which the underwind is located after the full winding of the bobbin 2. Upon running of the spindle 2 after the starting of the drive, a few windings of the thread 6 are wound on to the underwind crown 4, and as a rule a few turns of thread from the preceding underwinding are still located on its sleeve part 5. In order to cut the thread extending from these windings to the finished wound bobbin, the extent of which thread leading to the bobbin core is shown in FIGS. 1 and 2 at 6*a* and the end of which is shown on the bobbin at 6*e*, there may if desired, as shown in the example illustrated, project from the base of the recesses 8 in the annular rim 7 the cutting edges 12 of knives 13 (FIG. 1). The knives 13 are secured by bolts to the underwind crown 4 behind the recesses 8. With thread 6 of lower strength the separation of the portion of thread extending from the bobbin to the windings on the sleeve part could be effected without the said knives, by simply breaking it when lifting off the fully wound bobbin.

Figure 3:
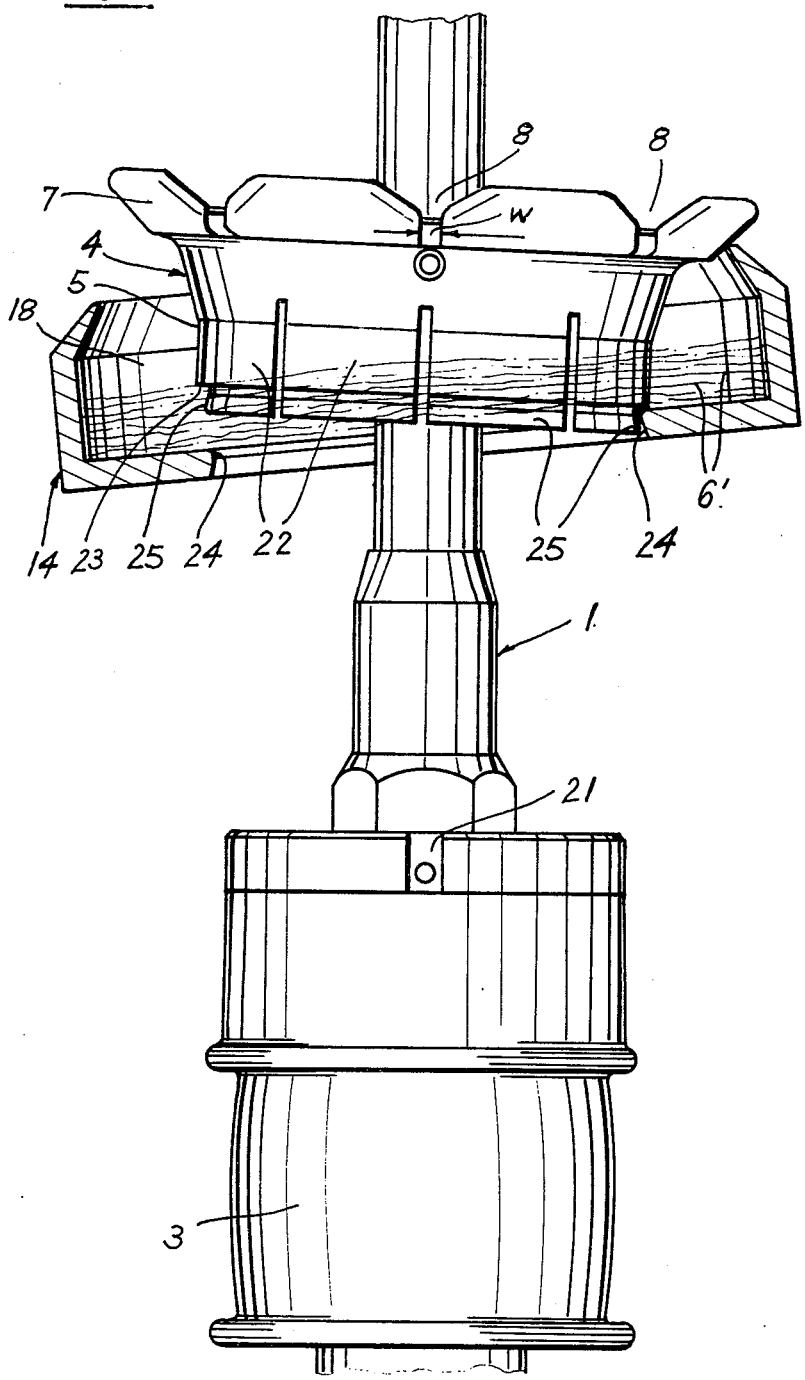
FIG. 3 shows the spindle of FIGS. 1 and 2, but without bobbin and with upwardly drawn underwind crown.

Around the cylindrical sleeve part 5 of the underwind crown 4 is arranged an upwardly open thread catch box 14 the annular base 15 of which extends outwardly from the lower end 5*u* of the sleeve part 5 and the outer wall 16 of which reaches as far as the upper end 5*o* of the sleeve part 5, leaving an annular gap 17 between itself and the annular rim 7. In the annular space 18 enclosed by the cylindrical sleeve part 5, the floor 15 and the outer wall 16, pieces of thread 6' released from the underwind crown 4 may collect, as shown in FIGS. 2 and 3, without the risk of their being thrown from the underwind crown 4, possibly becoming torn and causing damage to the frame and interference during winding of adjacent bobbins.

As can be seen from the drawings, the outer wall 16 of the thread catch box preferably tapers upwardly. In this way the pieces of thread 6' collected in the thread catch box are retained with still greater certainty in the annular space 18 when a large quantity of pieces of thread 6' is already located in the box. Advantageously, the outer wall 16 tapers conically towards its upper rim at least over a part of its height, whereby pieces of thread 6' shifted outwardly by centrifugal force are at the same time moved downwardly, so that at the beginning of the underwind the thread 6 can always enter the annular gap 17 and become wound on the underwind crown 4.

In the practical form illustrated the sleeve part 5 of the underwind crown 4 — preferably from about the central part of its height — is widened conically. This has the effect that at the beginning of the underwind the first winding of the thread 6 is located approximately in the transition from the cylindrical section of the sleeve part 5 to its conically widened section, whereupon the following windings adjoin it upwardly. The pull on the end opening downwardly into the winding upon lifting off of the fully wound bobbin leads, as a result of the conicity of the upper sleeve section, to fixing of the windings, so that pulling away is avoided. Furthermore, after the said pull has ended the thread 6 wound in a few windings on the underwind crown slips downwards more easily from the sleeve part 5 and passes into the lower region of the thread catch box 14, where it is less of a hindrance to the formation of new windings during subsequent underwindings.

In order to facilitate the emptying of the thread catch box 14, which in the foregoing example needs to take place only after up to 30 bobbin changes, the underwind crown 4 which is connected non-rotatably to the spindle 1 is preferably slipped on to the spindle 1 and held in operative position by spring loaded ball catches 19. The underwind crown 4 is held against rotation by a projecting flange 20 of a ball housing inserted into the underwind crown 4, which engages in a groove 21 on the spindle body. With advantage the thread catch box 14 is releasably connected to the underwind crown 4, so that the annular space enclosed by the outer wall 16 is more readily accessible. For this purpose the thread catch box 14 may be placed on the underwind crown 4 and held by spring catch elements 22. In the drawing these catch elements may be formed by downwardly directed tongues 22 of the sleeve part 5, on which stop shoulders 23 for the floor 15 of the thread catch box 14 and outwardly projecting holding plates 25 resiliently engaging behind the internal circular rim 24 of the base 15 are provided (FIG. 3). In order in particular to make possible easy assembly of the underwind crown 4 and the thread catch box 14 the holding plates 25 and the inner circular rim 24 of the base are rounded. The connection which is shown in FIG. 3 in the released condition, is easily effected since it essentially needs, after suitable shaping of the underwind crown 4 as a rotatable part, only the formation of the slots extending from below to about the middle of this component. As can be seen from FIG. 1, very secure fixing of the thread catch box 14 to the underwind crown 4 is achieved, since after placing the crown on a corresponding cylindrical section of the spindle 1 the said tongues 22 can no longer bend resiliently inwards but abut the cylindrical section.

In the practical example illustrated in the drawings a disc bobbin is placed on the spindle 1 and has an underwind crown 4 in which knives 13 in the recesses 8 in the annular rim 7 are provided. In order that upon starting of the ring bank 9 and the beginning of the winding of a new bobbin the thread 6 may not enter too far into one of the recesses 8 and be cut by the knife 13, the diameter D of the lower bobbin disc 26 is preferably larger than the diameter *d* on which the cutting edges 12 of the knives 13 are located (FIG. 1). For entraining the thread 6 at the beginning of the underwind and at the beginning of a new winding on to a empty bobbin the lower bobbin disc 26 has entraining grooves 27 at the periphery. The height and diameter D of the bobbin disc 26 are so selected that the thread 6 guided from the sleeve part 5 of the underwind crown 4 to the base of one of the grooves 27 extends upwardly at a distance from the knives 13. Only when the bobbin is pulled upwardly does the thread 6 come into engagement with one of the knives 13 and be cut.

Preferably the bobbin disc 26 has a downwardly directed peripheral enlargement 28, from the lower rim of which the thread 6 extends to the sleeve part 5 of the underwind crown 4 and which engages from above over the annular rim 7 of the underwind crown (FIG. 1). By this peripheral enlargement 28 the thread 6 is spaced with even more certainty from the knives 13 with the bobbin in place, and upon dropping of the ring bank prevents the threads from entering the narrow annular gap 29 between the upper annular rim 7 of the underwind crown 4 and the bobbin disc 26, whereupon thread breakage could very easily occur.

When removing the thread catch box 14 from the underwind crown 4 already briefly described (see FIG. 3) the fingers of one hand engage the upper annular rim 7 of the crown, whilst the fingers of the other hand engage the inwardly inclined upper boundary of the thread catch box 14. In order that cutting of the fingers may be avoided, the recesses 8 in the upper rim 7 of the underwind crown 4 are narrowed to a V-shape, the recesses advantageously being narrowed to a width *w* which is smaller than the thickness of a finger.

The spindle 1, as above described, together with the underwind crown 4 permits trouble-free replacement of the fully wound bobbin 2 by an empty bobbin, in that the full bobbin is simply pulled upwardly and thereupon the empty bobbin is simply placed on the spindle without additional application of the end of the thread, and can then be wound. The loosening of the windings of the thread on the sleeve part 5 that very easily occurs owing to the frequently very smooth outer surface of the sleeve part 5 of the underwind crown does not cause any trouble or soiling of the twisting frame, because any loose thread parts 6' are collected in the thread catch box 14.

The embodiments of the invention in which an exclusive property or privilege is claimed are defined as follows:

1. In a spindle for ring spinning and ring twisting frames for cord twisting frames having a bobbin, a whorl positioned beneath said bobbin, an underwind crown arranged coaxially on said spindle beneath said bobbin and above said whorl, said underwind crown having an extensively cylindrical sleeve part for the winding of a thread during underwind and an outwardly extending annular rim with recesses therein on the periphery thereof, and at least one knife having a cutting edge thereon projecting from the bases of said recesses comprising the improvement wherein around said cylindrical sleeve part of said underwind crown there is arranged an upwardly open thread catch box having an annular base which extends outwardly from the lower end of said sleeve part, the outer wall of said annular base extending to the height of the upper end of said sleeve part, an annular gap being defined between said outer wall and said annular rim on said sleeve part.

2. The improved spindle according to claim 1, wherein said outer wall of said thread catch box converges radially inwardly from the bottom toward the rim thereof.

3. The improved spindle according to claim 2, wherein said outer wall converges conically radially inwardly toward said rim thereof over at least a part of its height.

4. The improved spindle according to claim 1, wherein said sleeve part of said underwind crown diverges conically radially outwardly in an upwardly direction about the central region of its height.

5. The improved spindle according to claim 1, wherein said underwind crown is slipped on to said spindle and is held in an operative position by spring loaded detent balls.

6. The improved spindle according to claim 1, wherein said thread catch box is releasably connected to said underwind crown.

7. The improved spindle according to claim 6, wherein said thread catch box is placed on said underwind crown and is held by resilient detent elements.

8. The improved spindle according to claim 7, wherein said detent elements are formed by downwardly directed tongues on said sleeve part on which are provided stop shoulders for said base of said thread catch box and outwardly projecting holding enlargements resiliently engaging behind the inner circular rim of said base.

9. The improved spindle according to claim 8, wherein said holding enlargement and said inner circular rim of said base are rounded.

10. The improved spindle according to claim 1, including a lower bobbin disc; and wherein the diameter (D) of said lower bobbin disc is larger than the diameter (d) on which said cutting edges of said knives are located.

11. The improved spindle according to claim 10 including entraining grooves at the periphery of said lower bobbin disc;

wherein the thread guided from said sleeve part of said underwind crown to the base of one of the grooves of said entraining grooves extends upwardly a distance from said knives.

12. The improved spindle according to claim 10, wherein said lower bobbin disc has a downwardly directed peripheral enlargement from the lower rim of which said thread extends to said sleeve part of said underwind crown and which engages said annular rim of said underwind crown from above.

13. The improved spindle according to claim 10, wherein said recesses in said annular rim of said underwind crown are narrow in V form.

14. The improved spindle according to claim 13, wherein said recesses converge to a width (w) that is smaller than the thickness of a finger of a hand.

* * * * *